United States Patent [19]

Sasaki et al.

[11] 3,941,963

[45] Mar. 2, 1976

[54] CIRCUIT BREAKER

[75] Inventors: Kouji Sasaki; Seizo Nakano; Tohru Tsubaki, all of Hitachi, Japan

[73] Assignee: Hitachi, Ltd., Japan

[22] Filed: May 14, 1974

[21] Appl. No.: 469,761

[30] Foreign Application Priority Data

May 21, 1973 Japan ..... 48-57078

[52] U.S. Cl...... 200/148 A; 200/148 G; 200/148 D

[51] Int. Cl.[2] ..... H01H 33/88

[58] Field of Search..... 200/148 A, 148 B, 148 G, 200/148 R, 148 D

[56] References Cited

UNITED STATES PATENTS 3,214,550 10/1965 Easley ..... 200/148 A

FOREIGN PATENTS OR APPLICATIONS 21,605 1969 Japan ..... 200/148 G

*Primary Examiner*—Robert S. Macon

*Attorney, Agent, or Firm*—Craig & Antonelli

[57] ABSTRACT

In a circuit breaker having puffer type circuit breaking units housed within a tank of metal material, an inspection opening is formed in the tank side wall at a position opposite to a contact assembly in each of the circuit breaking units and is tightly closed by a detachable cover.

6 Claims, 4 Drawing Figures

CIRCUIT BREAKER

BACKGROUND OF THE INVENTION

This invention relates to circuit breakers and more particularly to a circuit breaker of the kind in which a puffer type circuit breaking unit is housed within a tank of metal material for compressing an arc extinguishing gas and supplying a puff of this compressed gas to the space between the parted contacts as soon as the circuit breaking operation takes place.

The increase in the electric power demand in recent years is quite remarkable, and this is accompanied by a tendency toward a further increase in the capacity of power systems. Circuit breakers are used in a power system as a means for protecting the power system against short-circuit and other troubles. In the event of occurrence of trouble in a section of the power system, the circuit breakers must interrupt immediately the flow of current through the electrical path in order to quickly cut off the faulty section from the remaining sound sections. The current, for example, short-circuit current to be interrupted increases remarkably with the increase in the capacity of the power system. Thus, the contact assembly in the circuit breaking unit in which an arc is produced during the interruption of the short-circuit current tends to be excessively damaged due to the fact that the arc energy is very large. Therefore, the contact assembly must be inspected after the interruption of such a large current or periodically and must be replaced by new parts as required. However, the period of time required for this work must be reduced to a minimum since power supply is interrupted completely during this period of time. This is demanded especially in principal power transmission lines.

In the prior art circuit breakers of this kind, the entire circuit breaking unit is taken out of the tank for the inspection or replacement of the contact assembly. However, the work for taking the circuit breaking unit out of the tank is extremely troublesome. Further, this work is inefficient and time consuming since the entire circuit breaking unit must be taken out of the tank in spite of the fact that the inspection is actually required for the contact assembly only. Further, in the case of circuit brakers having a higher voltage rating and a larger capacity, this work becomes more troublesome and time consuming since it is required to provide impedance elements such as making resistors or voltage dividing capacitors in electrically parallel relation with the circuit breaking unit.

SUMMARY OF THE INVENTION

It is an object of the present invention to provide a novel and improved circuit breaker in which the inspection or replacement of the contact assembly can be carried out efficiently within a short period of time.

Another object of the present invention is to provide a circuit breaker in which means are provided for facilitating the mounting and dismounting of the contact assembly for inspection and replacement.

Still another object of the present invention is to provide a circuit breaker in which the means provided for attaining the objects above described can be utilized for various other purposes so as to simplify the overall structure.

DESCRIPTION OF THE PREFERRED EMBODIMENT

Figure 1:
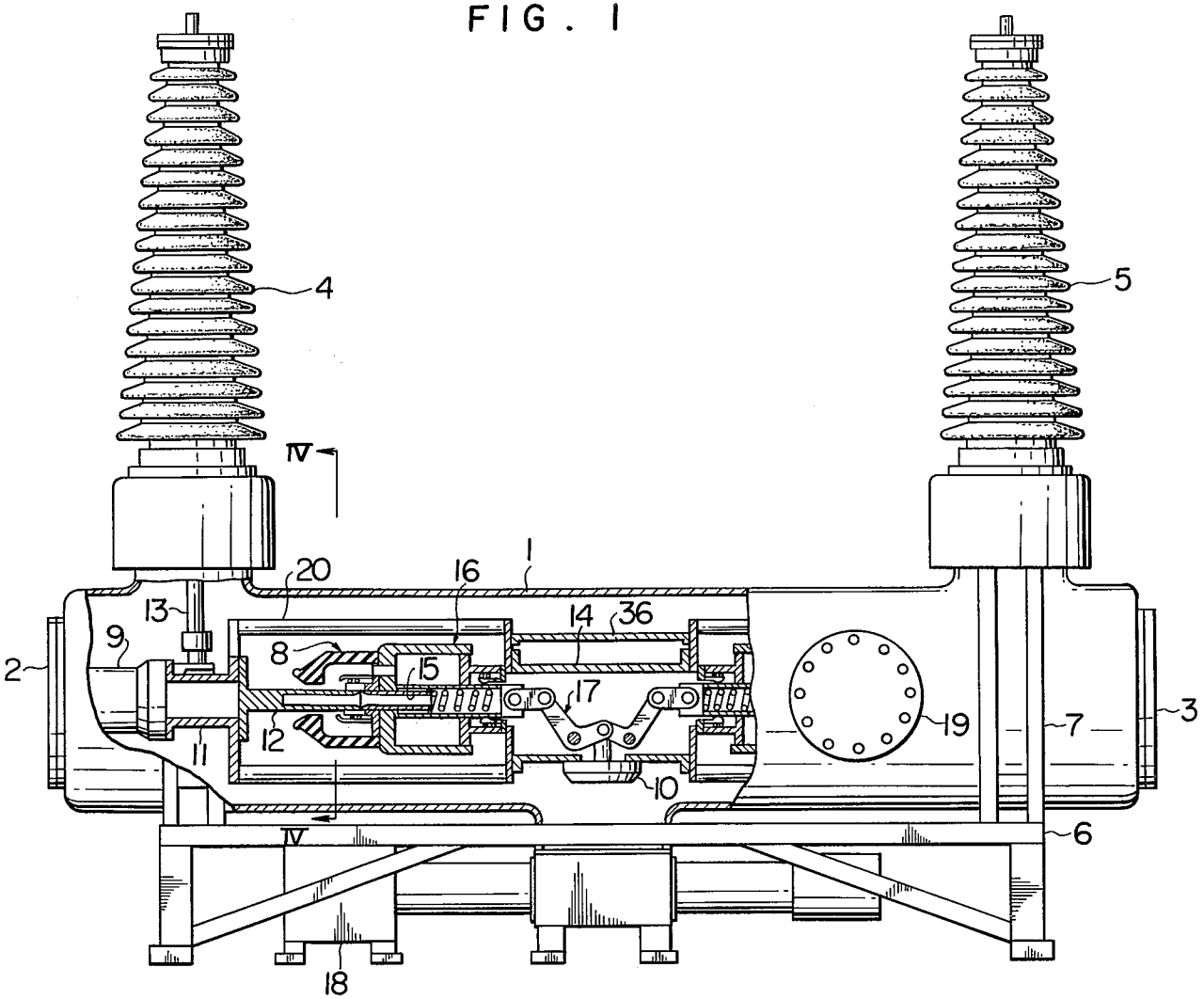
FIG. 1 is a partly sectional front elevational view of an embodiment of the circuit breaker according to the present invention.
Figure 2:
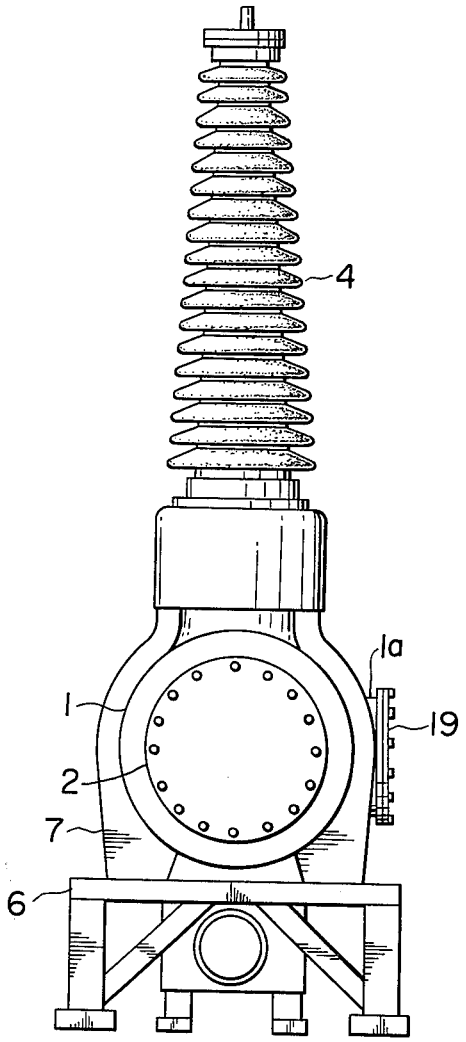
FIG. 2 is a side elevational view of the circuit breaker shown in FIG. 1.

FIGS. 1 and 2 show a circuit breaker having a pair of puffer type circuit breaking units providing two breaking points arranged in series. The structure of the left-hand side breaking unit only will be described in detail since the breaking units in FIG. 1 are arranged symmetrically with each other.

Referring to FIGS. 1 and 2, the opposite end openings of a tank 1 of metal material are tightly closed by covers 2 and 3. An arc extinguishing gas, for example, $SF_6$ of single pressure is charged in this tank 1. A pair of bushings 4 and 5 are erected on the upper part of the tank 1 and are spaced apart from each other by a predetermined insulating distance. These bushings 4 and 5 are supported on the foundation by ribs 7 and a base 6. One of the breaking units is designated by the reference numeral 8. This breaking unit 8 is supported in position by a cylindrical supporting member 9 of electrical insulator fixed to the cover 2 of the tank 1 and by another cylindrical supporting member 10 of electrical insulator fixed in a position intermediate between the axial ends of the tank 1. A stationary contact 12 is connected to the cylindrical supporting member 9 of electrical insulator by a supporting conductor 11 which is a main circuit conductor, and a central conductor 13 in the bushing 4 is connected to the supporting conductor 11. A central bracket 14 is fixedly supported on the cylindrical supporting member 10 of electrical insulator, and a movable contact 15 is electrically connected to this central bracket 14. The breaking units are electrically connected in series with each other by a connecting conductor 36 provided on the outer periphery of the central bracket 14. A gas compressing means 16 is connected to the movable contact 15. This gas compressing means 16 compresses the arc extinguishing gas in the tank 1 in response to the parting movement of the movable contact 15 away from the stationary contact 12 and supplies a puff of this compressed arc extinguishing gas to the space between the parted contacts 12 and 15. The movable contact 15 is moved away from the stationary contact 12 by being actuated by an actuator 18 through a link means 17 mounted to the central bracket 14. The actuator 18 is disposed beneath the tank 1. A cylindrical portion 1a is formed on the side wall of the tank 1 at a position opposite to the stationary contact 12 and movable contact 15 in each of the two breaking units 8, and the flange of this cylindrical portion 1a is tightly closed by a detachable cover 19. Impedance elements 20 are provided in electrically parallel relation with the contacts 12 and 15. These impedance elements 20 may be voltage dividing capacitors for uniformalizing the voltage applied to each of the breaking points arranged in series or making resistors for suppressing the surge voltage appearing when the circuit breaker is restored from the breaking position.

Figure 3:
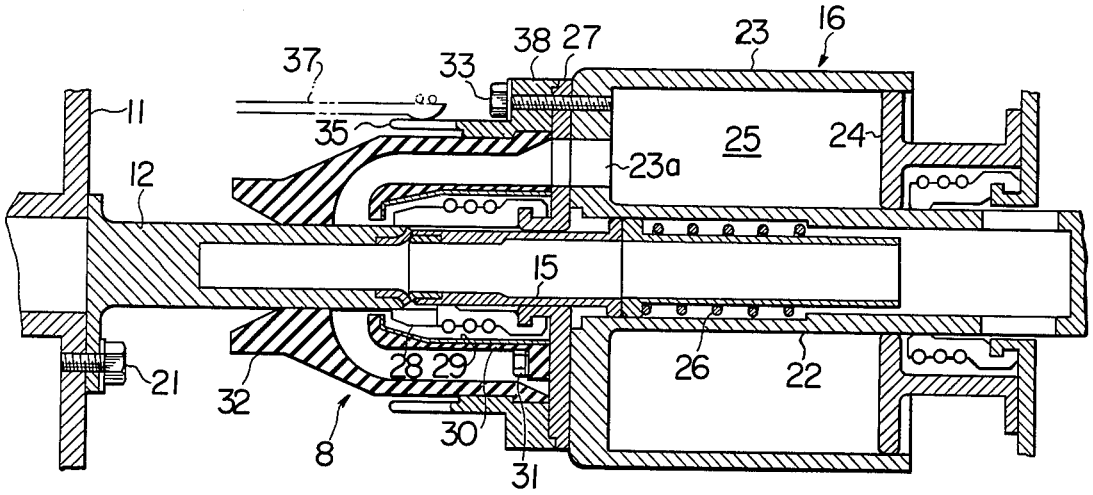
FIG. 3 is an enlarged longitudinal sectional view of the circuit breaking unit in the circuit breaker shown in FIG. 1.

The structure of the breaking unit 8 is shown in detail in FIG. 3. Referring to FIG. 3, the stationary contact 12 is fixed by bolts 21 to the supporting conductor 11 which is the main circuit conductor. A hollow conductive member 22 is connected to one end of the link means 17 shown in FIG. 1, and a puffer cylinder 23 is formed integrally on the outer periphery of the hollow conductive member 22. The right-hand end opening of this puffer cylinder 23 is closed by a piston 24 which is fixed to the central bracket 14. The puffer cylinder 23 and piston 24 define a puffer chamber 25 of the gas compressing means 16. Therefore, when the conductive member 22 is urged rightward in FIG. 3 by the actuator 18, the arc extinguishing gas in the puffer chamber 25 is compressed to be forced out of an opening 23*a* of the puffer cylinder 23.

A coil spring 26 is disposed within the hollow space of the conductive member 22 so as to normally urge the movable contact 15 toward the stationary contact 12. These two contacts 12 and 15 are disposed in electrically series relation between the members constituting the main circuit. The movement of the movable contact 15 toward the stationary contact 12 is limited by a current collector holder 27. Thus, when the conductive member 22 is urged rightward in FIG. 3, the movable contact 15 makes wiping movement relative to the stationary contact 12 and the arc extinguishing gas in the puffer chamber 25 is compressed. When the movable contact 15 is engaged by the current collector holder 27, parting of the contacts 12 and 15 takes place. The current collector holder 27 supports a current collector 28 which connects electrically the contacts 12 and 15 with each other. The current collector 28 is covered by a shielding member 29 and a cover 30 of electrical insulator fixed to the puffer cylinder 23 by bolts 31. This insulating cover 30 is surrounded in suitably spaced relation by a nozzle 32 of electrical insulator. This nozzle 32 is fixed by bolts 33 to the puffer cylinder 23 through a holding member 38 disposed on an outer peripheral portion thereof. Further, the stationary contact 12 extends into the nozzle 32 through the throat portion of the nozzle 32. The opening 23*a* of the puffer cylinder 23 opens into the space within the nozzle 32 so that the arc extinguishing gas compressed in the puffer cylinder 25 can be guided by the nozzle 32. In the present embodiment, the stream of this arc extinguishing gas is divided into a portion flowing to the exterior through the hollow space of the movable contact 15 and through the hollow space of the conductive member 22 and another portion flowing to the exterior through the throat portion of the nozzle 32.

The circuit breaking operation will now be briefly described. The arc extinguishing gas in the puffer chamber 25 is compressed when the conductive member 22 is urged to the right in FIG. 3 by being actuated by the actuator 18 through the link means 17 shown in FIG. 1. This compressed arc extinguishing gas is guided by the nozzle 32 to apply a puff for extinguishing the arc produced due to the parting of the contacts 12 and 15.

During this breaking operation, the contact assembly consisting of the contacts 12 and 15 tends to be damaged by the arc produced due to the contact parting. Thus, after the interruption of current, the contact assembly must be inspected for damage and must be replaced as required. In this inspection work, the arc extinguishing gas in the tank 1 is replaced by air and then the covers 19 shown in FIGS. 1 and 2 are removed to expose the inspection openings. The bolts 33 shown in FIG. 3 are then removed through these inspection openings, and the movable contacts 15 are taken out of the tank 1 together with the nozzles 32 and associated members. The movable contacts 15 are replaced by new ones when so required. Further, the stationary contacts 12 are similarly inspected by removing the bolts 21.

The opening 1b formed in each of the cylindrical portions 1a has a diameter which permits taking in and out of the nozzle 32. It will be seen that the period of time required for the inspection of the contact assembly in the circuit breaker of the present invention can be remarkably reduced compared with the prior art method in which the entire breaking unit is taken out of the tank for inspection. Such reduction can be attained because it is unnecessary to dismount and mount the parts including the gas compressing means 16.

In the circuit breaker of this kind which is rated at a large current, contacts for providing a main conduction path are disposed adjacent to the outer periphery of the nozzle 32 of electrical insulator in order to ensure a sufficiently wide conduction area. In the circuit breaker of this kind, the portion of the holding member 38 lying between the bolts 33 and the nozzle 32 of electrical insulator serves as a main movable contact 35 for establishing the main conduction path as shown in FIG. 3. A main stationary contact 37 is disposed opposite to this main movable contact 35 and is detachably mounted to the supporting conductor 11 by bolts.

Figure 4:
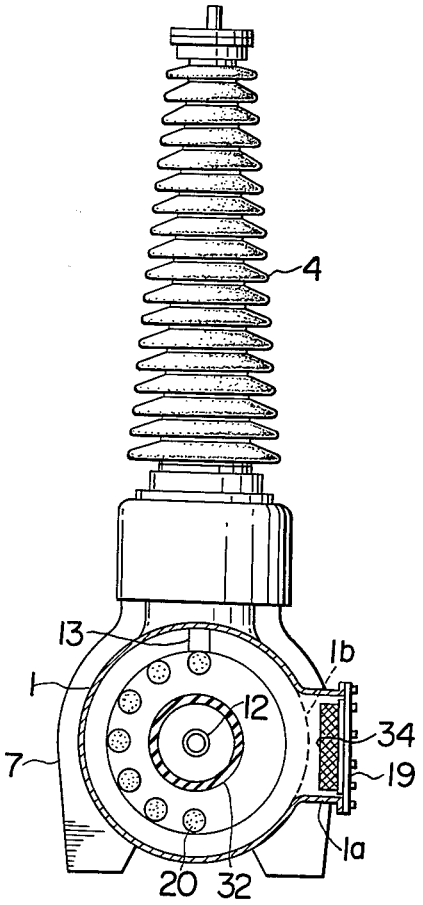
FIG. 4 is a sectional view taken on the line IV — IV in FIG. 1.

In the circuit breaker of this kind which is designed to have a large capacity, impedance elements 20 are disposed in electrically parallel relation with the contacts 12 and 15 as described previously. These impedance elements 20 may obstruct the replacement of the contacts. To obviate this obstruction, a space required for the taking in and out of the nozzle 32 of electrical insulator is preserved in the portion opposite to the inspection opening 1b as shown in FIG. 4. In other words, the impedance elements 20 are disposed in the space between the nozzle 32 and the side wall of the tank 1 remote from the opening 1*b*. Even in the case in which these impedance elements 20 are combined together to form a columnar unit, this unit is not disposed in the space between the opening 1*b* and the nozzle 32. By virtue of such an arrangement, the impedance elements 20 disposed in parallel with the contacts 12 and 15 do not obstruct the inspection work on the contacts.

In FIG. 4, an adsorbent 34 is fixed to the inner surface of the cover 19 tightly closing the inspection opening 1*b* so as to adsorb moisture and decomposition products produced from the arc extinguishing gas due to the arc generated during the interruption of current. Therefore, the adsorbent 34 can also be inspected and replaced as required during the inspection work on the contacts. Hitherto, an additional opening has been provided in the tank 1 and the adsorbent 34 has been fixed to the cover tightly closing this opening.

According to the present invention, the cover 19 tightly closing the contact inspection opening 1*b* serves also as a means for mounting the adsorbent 34. Thus, any other openings need not be bored in the tank 1 except those bored in the side wall portions opposite to the contact assemblies in the breaking units. These inspection openings 1*b* ensure accessibility due to the fact that they are provided in the side wall of the tank 1. That is, provision of the inspection openings 1*b* in the side wall of the tank 1 is advantageous in that a sufficient working space can be obtained. On the contrary, provision of these openings 1*b* in the lower wall of the tank 1 is disadvantageous in that the working space is limited by the base 6 and actuator 18.

We claim:

1. A circuit breaker comprising:

a tank of metal material filled with an arc extinguishing gas of a single pressure;

at least two puffer type circuit breaking units disposed within said tank in series relation with each other and extending horizontally along the same axis, each of said breaking units including gas compressing means for compressing said arc extinguishing gas as soon as the breaking operation takes place, a nozzle of insulating material for guiding the compressed arc extinguishing gas, and a partible contact assembly detachably mounted to a main circuit conductor disposed within said tank;

actuating means for actuating said gas compressing means and said contact assembly;

an opening bored in the side wall of said tank at a position opposite to one of said contact assemblies, said opening having a diameter larger than the outer dimension of said nozzle; and a detachable cover tightly closing said opening.

2. A circuit breaker as claimed in claim 1, wherein an adsorbent for absorbing decomposition products of said arc extinguishing gas is fixed to the inner surface of said cover, said adsorbent being disposed outside of the inner radius of said tank.

3. A circuit breaker as claimed in claim 1, wherein a plurality of impedance elements are disposed within said tank in electrically parallel relation with a contact assembly, said impedance elements being concentrically arranged around a portion of said breaking unit other than a portion of said breaking unit in facing relation.

4. A circuit breaker as claimed in claim 1, wherein an opening is bored in the side wall of said tank at a position opposite each of said contact assemblies, each of said openings having a diameter larger than the outer dimension of said nozzle, each opening being provided with a detachable cover tightly closing said opening.

5. A circuit breaker as claimed in claim 4, wherein a plurality of impedance elements are disposed within said tank in electrically parallel relation with a respective contact assembly, said impedance elements being concentrically arranged around a portion of said breaking unit other than a portion of said breaking unit in facing relation to said opening.

6. A circuit breaker as claimed in claim 5, wherein an adsorbent for absorbing decomposition products of said arc extinguishing gas is fixed to the inner surface of said cover said adsorbent being disposed outside of the inner radius of said tank.

* * * * *